United States Patent [19]

Itoh

[11] 4,004,559

[45] Jan. 25, 1977

[54] ALARM DEVICE FOR USE IN EXHAUST GAS RECIRCULATING SYSTEM

[75] Inventor: Tomo Itoh, Katsuta, Japan

[73] Assignee: Hitachi, Ltd., Japan

[22] Filed: Nov. 5, 1974

[21] Appl. No.: 521,095

[30] Foreign Application Priority Data

Nov. 9, 1973 Japan ..... 48-125305

[52] U.S. Cl. ..... 123/119 A; 123/198 D

[51] Int. Cl.² ..... F02M 25/06

[58] Field of Search ..... 123/119 A, 198 D, 198 R

[56] References Cited

UNITED STATES PATENTS

| | | | |
|---|---|---|---|
| 3,779,222 | 12/1973 | Lorenz | 123/198 D X |
| 3,794,006 | 2/1974 | Woodward | 123/198 D X |
| 3,877,452 | 4/1975 | Nohira et al. | 123/119 A |
| 3,881,456 | 5/1975 | Nohira et al. | 123/119 A |
| 3,924,587 | 12/1975 | Murphy | 123/198 D X |
| 3,930,221 | 12/1975 | Thing | 123/198 D X |

*Primary Examiner*—Wendell E. Burns
*Assistant Examiner*—Ira S. Lazarus
*Attorney, Agent, or Firm*—Craig & Antonelli

[57] ABSTRACT

An alarm device for use in an exhaust gas recirculating system wherein part of exhaust gases from an internal combustion engine is introduced back into a suction system of the engine to thereby lower the combustion temperature of the engine, thus reducing the amount of nitric oxides contained in the exhaust gases. This alarm device is of the type which detects abnormal recirculating condition of recirculating exhaust gases to thereby warn of the abnormal operation of the exhaust gas recirculating system. The features of this alarm device are that the variation in flow rate of exhaust gases flowing through the exhaust gas recirculating passage communicating the exhaust gas system with a suction system is detected according to the pressure, whereby when the pressure thus detected deviates from the predetermined value, the abnormal-condition indicating device is driven to warn of the abnormal recirculation of exhaust gases.

4 Claims, 4 Drawing Figures

ALARM DEVICE FOR USE IN EXHAUST GAS RECIRCULATING SYSTEM

BACKGROUND OF THE INVENTION

This invention relates to an exhaust gas recirculating system wherein part of exhaust gases from an internal combustion engine is introduced back into a suction system of an engine to thereby lower the combustion temperature of the engine, thus reducing the amount of nitric oxides (which will be referred to simply as "NOx," hereinafter) contained in the exhaust gases, and more particularly to an alarm device for use in an exhaust gas recirculating system for detecting the abnormal recirculation of an exhaust gas recirculating flow.

Hitherto, an exhaust gas recirculating system has been proposed, in which part of exhaust gases from an internal combustion engine is introduced back into the engine to thereby reduce the amount of NOx contained in exhaust gases. It has been often experienced with this type of exhaust gas recirculating system that an exhaust gas control valve for controlling the recirculating flow rate of exhaust gases is damaged due to vibration or the like accruing from the travelling of a motor vehicle. As a result, the exhaust gas control valve will not operate in the normal condition so that an excessive amount of exhaust gases is fed into the engine, thus resulting in a lowered output or increase in the amount of hydrocarbons and carbon monoxide. In addition, it sometimes happens that a diaphragm in the exhaust gas control valve is broken, so that the control valve closes an exhaust gas recirculating passage, thus failing to feed exhaust gases into an engine, with the accompanying increase in the amount of NOx. Accordingly, it has long been desired to have an alarm device for notifying the abnormal recirculating condition of exhaust gases, thereby solving the aforesaid problems.

To meet such demand, there have been proposed an alarming device, by which to detect the stroke of an exhaust gas control valve in an exhaust gas recirculating system to warn of the abnormal recirculating condition of exhaust gases, or another alarm device by which to compare the pressure in a control pressure chamber in an exhaust gas control valve with a signal produced in a carburetor to thereby warn of the abnormal recirculating condition.

However, the alarm devices of this type are designed so as to directly detect the operating condition of an exhaust gas control valve, so that if a weld portion between a valve rod provided for a diaphragm and a valve portion in an exhaust gas control valve is ruptured or in case the valve rod causes troubles in its operation, there is a possibility of failing to detect the abnormal recirculating condition.

SUMMARY OF THE INVENTION

It is an object of the present invention to provide an alarming device for use in an exhaust gas recirculating system for positively detecting the abnormal recirculation of recirculating exhaust gases.

It is another object of the present invention to provide an alarm device for use in an exhaust gas recirculating system for postively detecting the abnormal condition, in whatever condition the abnormal recirculating flow may be.

According to one aspect of the present invention, there is provided an alarm device for use in an exhaust gas recirculating system, featuring the steps of extracting a first exhaust gas pressure from part of an exhaust gas recirculating passage which communicates an exhaust system with a suction system and then extracting a second pressure from the downstream side of the aforesaid extracting portion of the first exhaust gas pressure for the purpose of comparing the both pressures thus extracted with each other, whereby an abnormal-condition indicating device is driven according to the detection of variation in the flow rate of recirculating exhaust gases.

According to another aspect of the present invention, there is provided an alarm device, in which an abnormal condition indicating device is driven, when the exhaust recirculating gases are fed in an excessive amount or not fed into an engine at all, by the steps of: extracting a first exhaust gas pressure from part of an exhaust gas recirculating passage; then extracting a second exhaust gas pressure from downstream side of the extracting portion of the first exhaust gas pressure; feeding the both pressures thus extracted into a comparator means; feeding into a signal control means a signal to be produced when the difference between the both pressures deviates from a predetermined value and a signal to be produced when a pressure signal to be impressed on an exhaust gas control valve exceeds a predetermined value; and feeding an output from the signal control means into the abnormal-condition indicating device.

DESCRIPTION OF THE PREFERRED EMBODIMENTS

Figure 1:
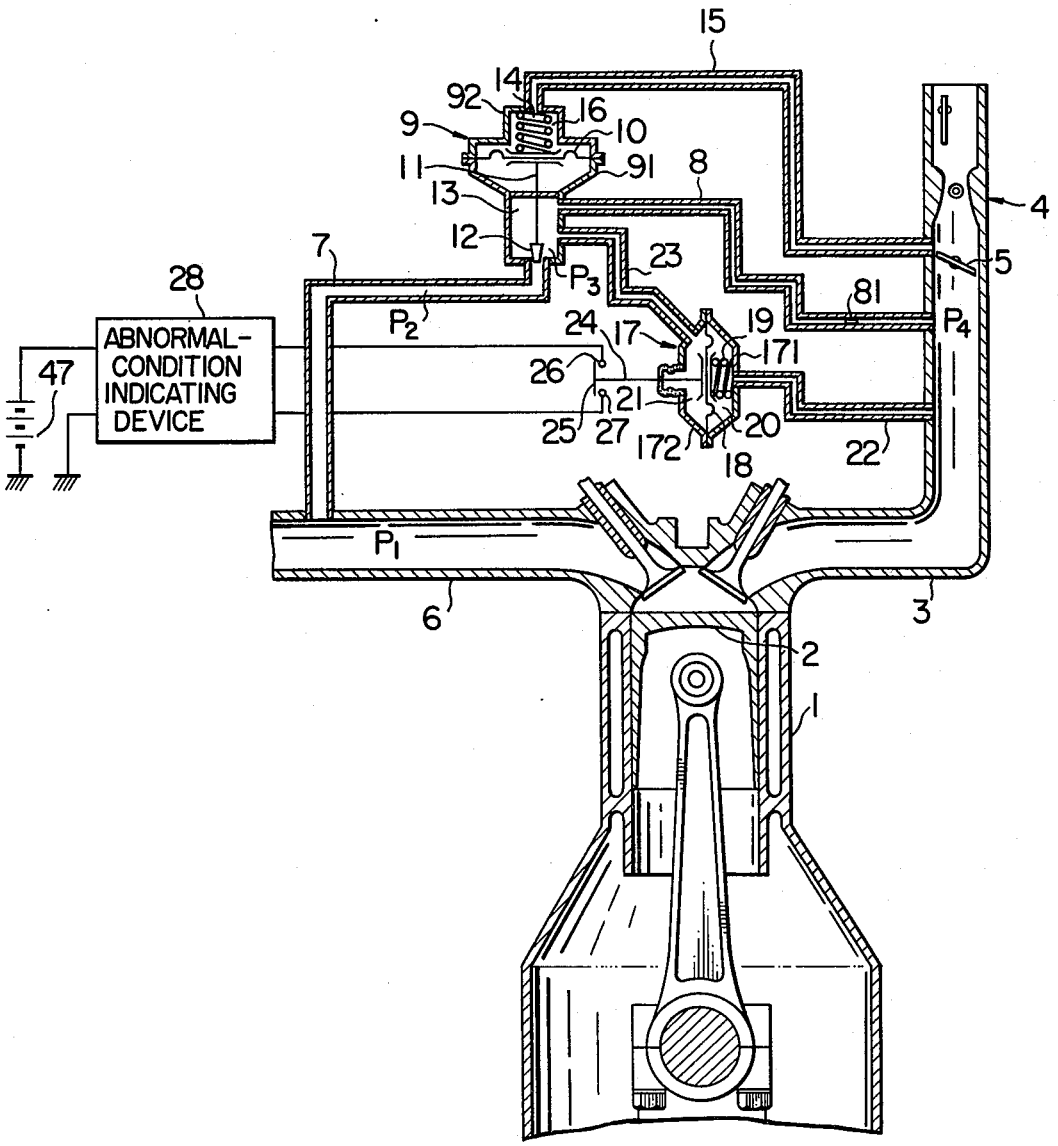
FIG. 1 is a schematic view of an alarm device for use in an exhaust gas recirculating system, shown as one embodiment of the present invention.

Referring now to FIG. 1, there is shown an embodiment of the present invention. Shown at 1 is a cylinder of an internal combustion engine, with a piston 2 being housed therein. Shown at 3 is a suction pipe which communicates a carburetor 4 with the interior of the cylinder 1. Provided in the carburetor 4 is a throttle valve 5 adapted to control the amount of a mixture charge to be fed into an engine. Designated 6 is an exhaust pipe communicated with the interior of the cylinder 1 for discharging exhaust gases, i.e., the burnt mixture charge to atmosphere. Shown at 7, 8 are exhaust gas recirculating passages communicating the exhaust pipe 6 with the suction pipe 3. In this respect, the suction pipe 3 may be regarded as being part of the exhaust gas recirculating passage. An exhaust gas control valve 9 is positioned between the passage 7 and the passage 8. In this respect, a throttled portion 81 provided in the exhaust gas recirculating passage 8 represents the gas flow resistance in the recirculating passage 8. The exhaust gas control valve 9 consists of a diaphragm 10 provided within a space confined by two housings 91, 92, a valve rod 11 secured to the diaphragm 10, a metering valve 12 secured to the tip of the valve rod 11, valve chamber 13, into which the exhaust gas recirculating passages 7, 8 are open, and a diaphragm spring 14 normally loaded so as to close the communication between the exhaust gas recirculating passage 7 and the valve chamber 13 by means of the metering valve 12. Shown at 15 is a negative pressure signal passage which is open in the vicinity of the throttle valve 5 in a carburetor and adapted to impress the negative pressure on the diaphragm 10 in the control pressure chamber 16 so as to open the metering valve 12. Designated 17 is a comparator means constituting the alarm device according to the present invention. The comparator means 17 consists of a comparing diaphragm 18 and a diaphragm spring 19 provided in the space confined by the two housings 171, 172. The comparing diaphragm 18 provided with the diaphragm spring 19 is communicated via a negative passage 22 with the suction pipe 3. On the other hand, an exhaust gas chamber consisting of the comparing diaphargm 18 and housing 172 is communicated via an exhaust gas passage 23 with the valve chamber 13. Shown at 24 is a rod rigidly secured to the comparing diaphragm 18, with an electric contact 25 being provided at the tip of the rod 24. Shown at 26, 27 are terminals connected to an abnormal-condition indicating device 28, and the terminals 26, 27 are adapted to feed an electric current so as to drive the abnormal-condition indicating device 28, when electric contact 25 is closed.

Now, description will be given of the operational phase of the alarm device according to the present invention.

At the time of starting run of an engine or at the time of idle running thereof, when an exhaust gas recirculating device is not operated, the metering valve 12 blocks the communication between the exhaust gas recirculating passage 7 and the valve chamber 13 by means of the diaphragm spring 14. At this time, assume the pressure P1 in the exhaust pipe 6, pressure P2 in the exhaust gas recirculating passage 7, pressure P3 in the valve chamber 13 and pressure P4 in the suction pipe 3, then $P1 = P2 > P3 = P4$, so that the comparator means 17 will not be actuated, with the electric contact 25 maintained open. In other words, since the pressure P3 in the valve chamber 13 is equal to the pressure P4 in the suction pipe 3, the comparing diaphragm 18 is biased under the action of diaphragm spring 19 to the left in FIG. 1, while the terminals 26, 27 and electric contact 25 are maintained open. As a result, the abnormal-condition indicating device 28 is not energized and hence kept in operable condition. Meanwhile, as the engine is accelerated from the low speed running to the high speed, there will be increased the negative pressure which is to be impressed via the negative signal passage 15 on the control pressure chamber 16. This causes the metering valve 12 to increase the opening angle of the metering valve 12, so that the amount of exhaust gases passing through the exhaust gas recirculating passages 7, 8 will be increased. In this respect, in case the exhaust gas control valve 9 is actuated normally during the low speed running, there results a relatively high negative pressure which is being impressed on the suction negative chamber 20, while the exhaust gas pressure to be impressed on the exhaust gas chamber 21 is low. Thus, the comparing diaphragm 18 is maintained to a given condition by means of the composite pressure thus obtained, due to the action of the diaphragm spring 19. In this condition, the electric contact 25 remains open, while the abnormal-condition indicating device 28 remains in non-operating condition. On the other hand, when the exhaust gas control valve 9 operates normally in the high speed running, the negative pressure to be impressed on the suction negative chamber 20 in the comparator means 17 is low, whereas the exhaust gas pressure to be impressed on the exhaust gas chamber 21 is increased. Thus, the comparing diaphragm 18 is maintained to a given condition by means of the composite pressure thus obtained, due to the action of the diaphragm spring 19. However, the electric contact 25 at this time remains open, and hence the abnormal-condition indicating device 28 will not be operated.

Meanwhile, when the amount of exhaust gases passing through the exhaust gas passages 7, 8 at the time of low speed running and the high speed running is greater than the amount thereof which is required to be fed to the exhaust gas control valve 9 through the negative pressure signal passage 15, i.e., in case the exhaust gases are fed to an engine in an excessive amount, there results an increase in the gas pressure to be impressed on the exhaust gas chamber 21 in the comparator means 17. Accordingly, the pressure being applied to the comparing diaphragm 18 is increased by an increment corresponding to the increase in the amount of exhaust gas recirculating flow, while the composite pressure of the suction pipe negative pressure and exhaust gas pressure becomes higher than that given by the diaphragm spring 19, so that the diaphragm spring 19 is slackened and the diaphragm 18 is displaced to the right in FIG. 1. In addition, the electric contact 25 secured through the medium of rod 24 to the diaphragm 18 connects the terminals 26, 27 together, thus energizing the abnormal-condition indicating device 28, to warn of the abnormal recirculation of exhaust gases. As can be seen from the aforesaid description, the alarm device according to the present invention directly detects the variations in the flow rate of exhaust gas recirculating flow, so positive detection of the abnormal recirculation of exhaust gases may be attained, and permits the rapid repair of the exhaust gas recirculating system.

Figure 2:
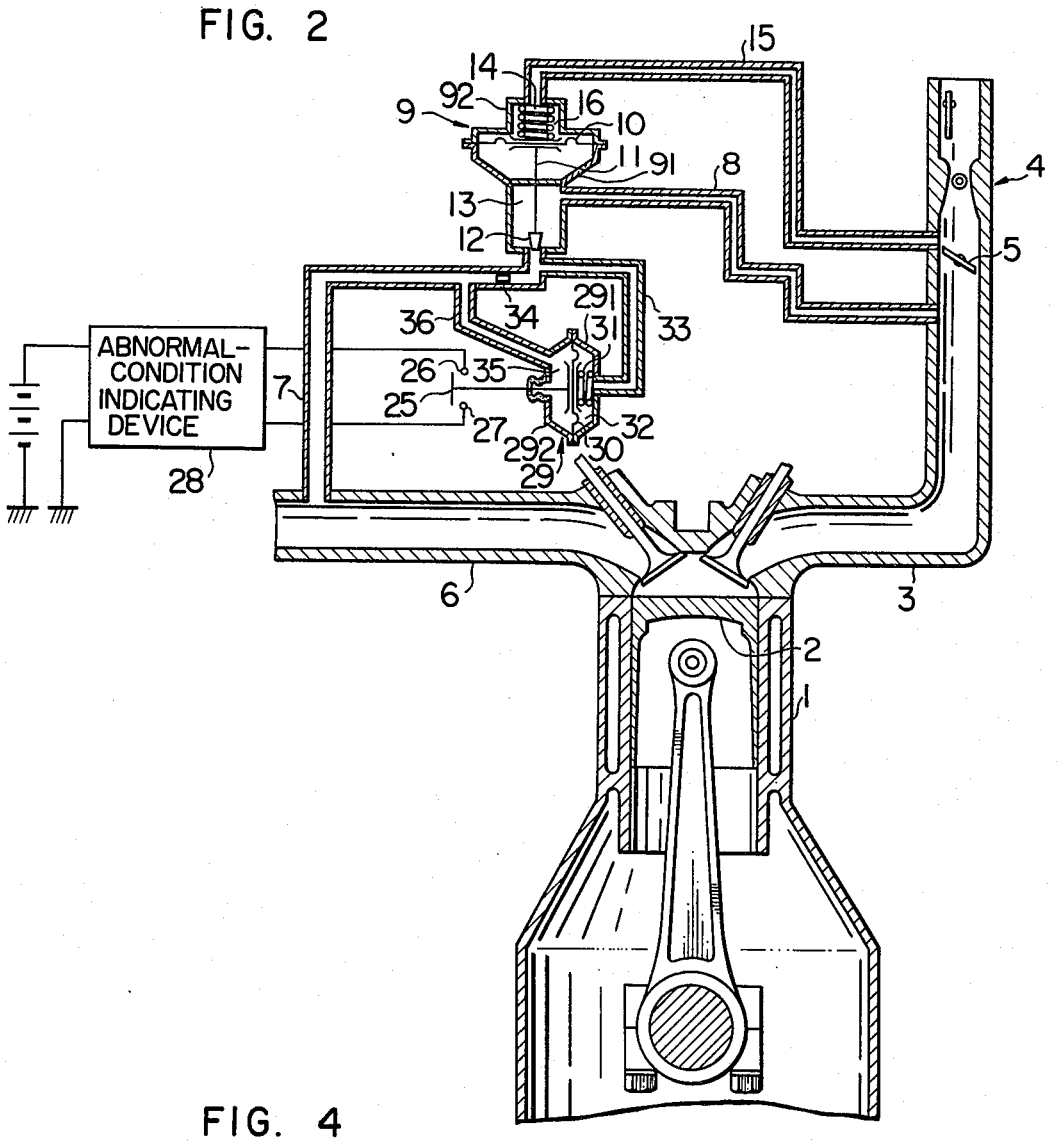
FIG. 2 is a schematic view of another embodiment of the present invention.

Referring now to FIG. 2 which shows another embodiment of the present invention. Like parts are designated like reference numerals throughout FIGS. 1 and 2. Shown at 29 is a comparator means which consists of a comparing diaphragm 39 and a diaphragm spring 31 provided in the space confined by two housings 291, 292. The comparing diaphragm 30 provided with the diaphragm spring 31, as well as a low pressure exhaust gas chamber 32 are in communication with the downstream of a throttled portion 34 provided in the exhaust gas recirculating passage 7. On the other hand, a high pressure exhaust gas chamber 35 defined by the comparing diaphragm 30 and housing 292 is communicated via a high pressure exhaust gas passage 36 with the upstream of the throttled position 36.

With the aforesaid arrangement, when the exhaust gas recirculating system is in non-operating condition at the time of starting an engine or at the time of idle running of the engine, the metering valve 12 blocks the communication between the exhaust gas recirculating passage 7 and the valve chamber 13. At this time, the pressure in the low pressure exhaust gas chamber 32 is equalized with that in a high pressure exhaust gas chamber 35, so that the comparing diaphragm 30 is displaced to the left in FIG. 2 due to the action of the diaphragm spring 31, with the electric contact 25 remaining open. As a result, the abnormal-condition indicating device 28 is not energized and hence not operated. As the engine is accelerated from the low speed running to the high speed, the opening angle of the metering valve 12 is increased, while the amount of the exhaust gases passing through the exhaust gas recirculating passages 7, 8 are increased. In this respect, when the exhaust gas control valve 9 is actuated normally during the low speed and high speed running of the engine, the pressure difference between the low pressure exhaust gas chamber 32 in the comparator means 29 and the high pressure exhaust gas chamber 35 is maintained to a given value, so the electric contact 25 is opened by means of diaphragm springs 31, while the abnormal-condition indicating device 28 will not be operated. When the amount of exhaust gases passing through the exhaust gas recirculating passages 7, 8 during the low speed and high speed runnings becomes greater than that required to be fed to the exhaust gas control valve 9 via negative pressure signal passage 15, i.e., in case the exhaust gases are fed into the engine in an excessive amount, the pressure in the high pressure exhaust gas chamber 35 becomes substantially equal to that prevailing in the exhaust pipe 6, while the pressure in the low pressure exhaust gas chamber 32 will be further lowered, because the metering valve 12 is opened to an abnormal extent. As a result, the pressure difference between the high pressure exhaust chamber 35 and the low pressure exhaust gas chamber 32 becomes greater than the predetermined value, so that the comparing diaphragm 30 is displaced to the right in FIG. 2 due to the pressure in the high pressure exhaust gas chamber 35, while the electric contact 25 connects the terminals 26, 27 together to thereby energize the abnormal-condition indicating device 28 so as to drive same, thus alarming the abnormal recirculating condition. Meanwhile, according to the embodiment, the pressure difference is detected by means of a throttled portion 34. However, the same effects may be attained by detecting the pressure difference by utilizing the gas flow resistance in the exhaust gas recirculating passages 7, 8.

Figure 4:
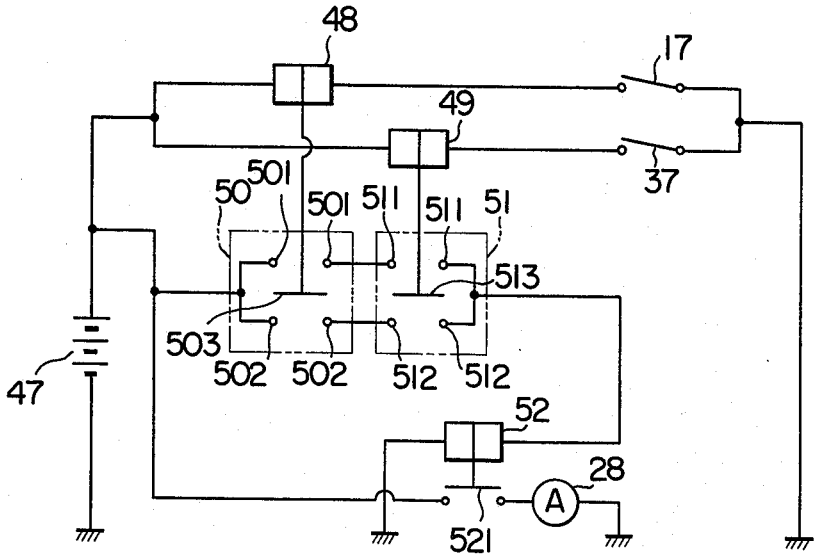
FIG. 4 is a circuit diagram of a signal control means for use with the alarm device shown in FIG. 3.
Figure 3:
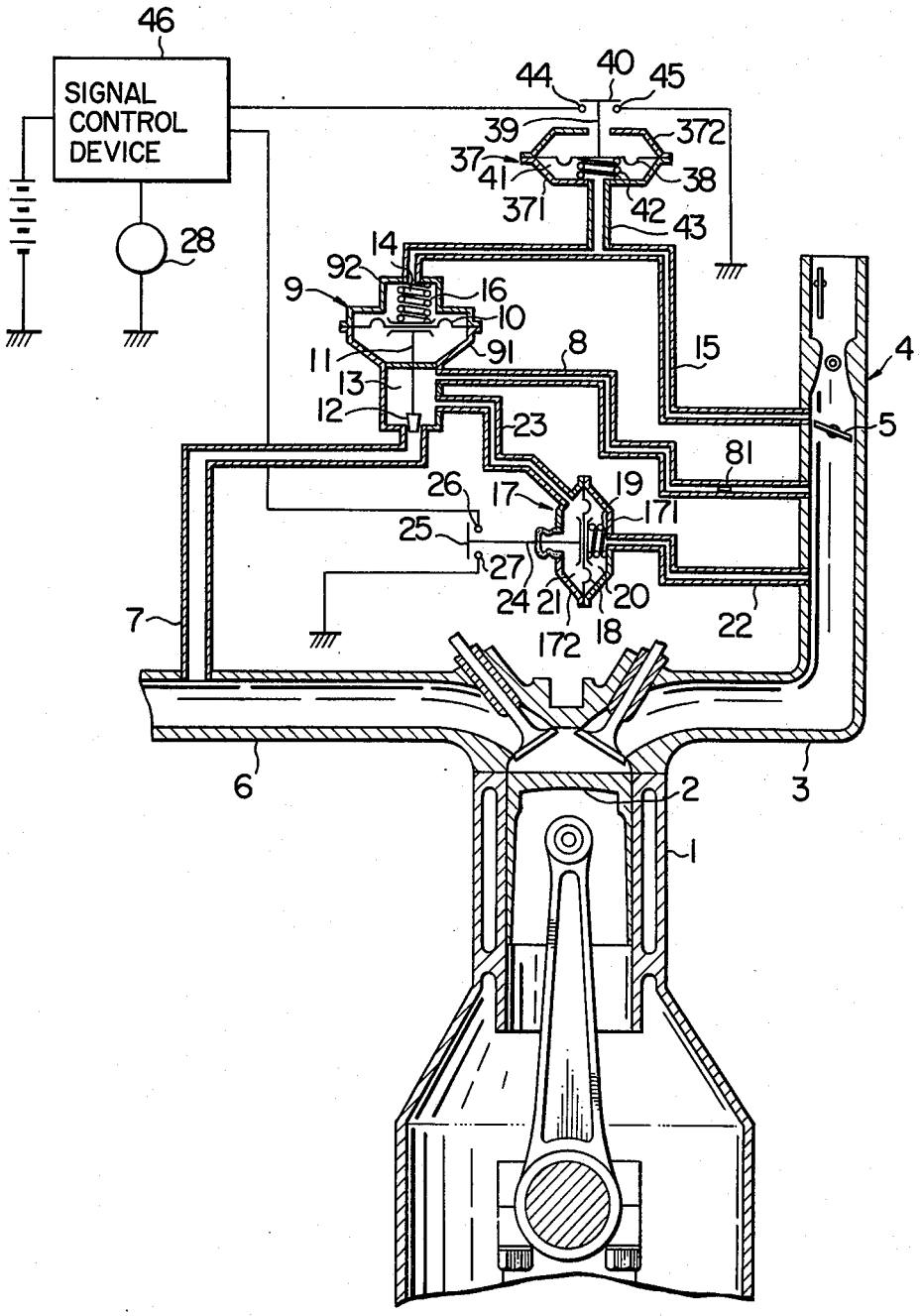
FIG. 3 is a schematic view of a still further embodiment of the alarm device of the present invention.

FIGS. 3 and 4 represent the modification of the present invention. Like parts in this case are designated like reference numerals in common with FIG. 1. Turning to FIG. 3, shown at 37 is a signal pressure detecting switch which consists of a detecting diaphragm 38 provided in the space confined by two housings 371, 372, a rod secured to the detecting diaphragm 38, an electric contact 40 rigidly mounted on the rod 39, and a diaphragm spring 42 provided in a signal pressure chamber 41 confined by a housing 371 and detecting diaphragm 38. The signal pressure chamber 41 is in communication with the negative pressure signal passage 15 by way of a signal passage 43. Shown at 44, 45 are terminals connected and grounded to the signal control device 46. The arrangement of the comparator means 17 is such that the moment the metering valve 12 of the exhaust gas control valve 9 is opened, the terminals 26, 27 are closed by means of the electric contact 25 and that the electric contact 25 is detached from the terminals 26, 27 by utilizing the increase in the displacement of the comparing diaphragm 18, when the exhaust gases flow in an excessive amount.

Now going into the description of the arrangement of a signal control device 46 with reference to FIG. 4. Shown at 47 is a battery, to which are connected in parallel the comparator means 17 and a signal detecting switch 37. Interposed between the comparator means 17 and the battery 47 is a first switch 48, while a second switch 49 is positioned between the signal detecting switch 37 and the battery 47. In addition, first and second contact portions 50, 51 of the first switch 48 and second switch 49 are connected in series, while one is connected to the battery 47 and the other is grounded via a relay 52. In this respect, the first contact portion 50 and the second contact portion 51 are provided with two switching terminals, 501, 502 and 511, 512, respectively. Thus, when the first contact 503 contacts the switching terminal 501, and the second contact 513 contacts the switching terminal 511, or when same contact switching terminals 502, 512, electricity is fed to the relay 52. In addition, one of the relay contact 521 of relay 52 is connected to the battery 47 and the other thereof is connected to the abnormal-condition indicating device 28.

With the aforesaid arrangement, at the time of starting an engine and at the time of idle running thereof, the metering valve 12 is maintained closed, so that the pressure in the suction negative pressure chamber 20 of the comparator means 17 is equalized with that in the exhaust gas chamber 21, while the comparator means 17 as well as the signal detecting switch 37 are maintained opened, without a given pressure being impressed on the detecting diaphragm 38. As a result, electricity will not be fed to the first switch 48 and second switch 49, while the first contact 503 contacts the terminal 501, and the second contact 513 contacts the switching terminal 512, respectively, so that electric current will now flow through the relay 52, with the relay contact 521 blocking the connection between the abnormal-condition indicating device 28 and the battery 47. When the exhaust gas control valve 9 starts the operation normally, then the comparator means 17 as well as the signal detecting switch 37 are closed. Accordingly, electric current flows through the first and second switches 48, 49, so that the first contact 503 contacts the switching terminal 502, and the second contact 513 contacts the switching terminal 511, while electric current will not flow through the relay 52, with the relay contact 521 blocking the connection between the abnormal-condition indicating device 28 and the battery 47.

Meanwhile, when the amount of exhaust gases to be fed to an engine is excessive, then the pressure in the exhaust gas pressure chamber 21 of the comparator means 17 is increased, while the comparing diaphragm 18 is further displaced so that the electric contact 25 is opened, thereby interrupting the flow of an electric current to the switch 48. When the feed of electric current to the first switch 48 is interrupted, then the first contact 503 contacts the switching terminal 501. On the other hand, since the second contact 513 contacts the switching terminal 511, electric current is fed to the relay 52, so that the battery 47 is connected to the abnormal-condition indicating device 28 by means of the relay contact 521, thus warning of the abnormal recirculation. On the other hand, in case the diaphragm 10 in the exhaust gas control valve 9 is broken or in the event that the metering valve 12 comes off the rod 11, so that the exhaust gases are not introduced into the engine, then the pressure in the exhaust gas chamber 21 in the comparator means 17 is equalized with the pressure prevailing in the suction negative pressure chamber 22, so that the electric contact 25 is opened. Accordingly, in this case as well, no electric current is fed to the contact 48, and the switching terminal 501 and first contact 503 are brought into contact with each other, while electric current is fed to the relay 52 to thereby energize the abnormal-condition indicating device 28. With the arrangement as shown in FIG. 3, when the exhaust gases to be fed from an exhaust gas purifying device to an engine is excessive or not entirely fed to the engine, the abnormal-condition indicating device may be driven, and hence permits the rapid repair of an exhaust gas purifying device. In passing, in the case of the embodiment as shown in FIG. 3, the signal detecting switch 37 is driven by the negative pressure, while the same effects may be attained by detecting the starting idle condition by using the negative pressure.

As is apparent from the foregoing description, the present invention can present an alarm device for use in an exhaust gas recirculating system, which device can positively detect the abnormal condition in the recirculating flow and is high in reliability, due to the direct detection of the variation in the flow rate of the exhaust recirculating gas.

What is claimed is:

1. In an exhaust gas recirculating system including an exhaust gas recirculating passage for introducing a final portion of an exhaust gas from an internal combustion engine into a suction system of an engine and an exhaust gas control valve driven by action of a negative pressure in the vicinity of a throttle valve for metering the exhaust gas in the recirculating passage, an alarm means for detecting abnormal exhaust gas recirculation in the recirculating system and issuing an alarm signal comprising:

means for comparing pressures between the recirculating passage portion downstream from said control valve and the suction system of an engine, means for detecting actuation of said control valve driven by action of a negative pressure applied to said control valve, signal control means operable in response to signals from said comparing means and said detecting means, and abnormal recirculation indicating means associated with said control signal whereby said control signal means actuates said abnormal recirculation indicating means both when an excess exhaust gas is recirculated and when no exhaust gas is recirculated at a time when recirculation is desired.

2. A system in accordance with claim 1, wherein said signal control means includes a first switch means, a second switch means and a third switch means selectively connected to a battery, said first switch means being operable in response to a signal from said comparing means, said second switch means being operable in response to a signal from said detecting means, and said third switch means being operable to actuate said abnormal recirculation indicating means when said first and second switch means are connected in series to the battery.

3. An alarm device for use in an exhaust gas recirculating system as set forth in claim 1, wherein there is provided a throttled portion upstream of an exhaust gas control valve which is adapted to control the amount of exhaust gases flowing through exhaust gas recirculating passages, commensurate with the running condition of an engine, and pressures prevailing upstream and downstream of said throttled portion are fed into a comparator means which is adapted to be operated at a predetermined pressure, whereby difference between said both pressures exceeds a predetermined value, an abnormal-condition indicating device is operated by means of said comparator means.

4. An alarm device for use in an exhaust gas recirculating system as set forth in claim 3, wherein said comparator means includes a diaphragm provided within housings, said diaphragm being of such an arrangement that exhaust gas pressure upstream of said throttled portion is applied to one surface of said diaphragm, while the exhaust gas pressure downstream thereof is applied to the other surface of said diaphragm, so that when said both pressures exceed a predetermined value, said diaphragm is displaced, whereby an abnormal-condition indicating device is driven due to the variation in outputs obtained therefrom.

* * * * *